US005640765A

United States Patent [19]

Wiemeyer et al.

[11] Patent Number: 5,640,765

[45] Date of Patent: Jun. 24, 1997

[54] METHOD FOR ELECTRICALLY AND CONDUCTIVELY CONNECTING TWO ELECTRICAL LINES

[75] Inventors: Hans Heinrich Wiemeyer, Gernsbach; Dieter Zimmer, Muggensturm, both of Germany

[73] Assignee: Alcatel Kabel AG & Co., Hanover, Germany

[21] Appl. No.: 479,172

[22] Filed: Jun. 7, 1995

[30] Foreign Application Priority Data

Aug. 4, 1994 [DE] Germany ..... 44 27 566.8

[51] Int. Cl.[6] ..... H01R 43/00

[52] U.S. Cl. ..... 29/868; 29/869; 174/77 R; 174/92

[58] Field of Search ..... 174/92, 93, 77 R; 29/869, 868

[56] References Cited

U.S. PATENT DOCUMENTS

| | | | |
|---|---|---|---|
| 3,146,299 | 8/1964 | Norton | 174/88 |
| 3,244,796 | 4/1966 | Stark et al. | 174/77 |
| 3,617,614 | 11/1971 | Henry | 174/77 R |
| 3,836,699 | 9/1974 | Downing | 174/92 X |
| 3,916,956 | 11/1975 | Eidelberg et al. | 174/77 R |
| 4,427,842 | 1/1984 | Anderson | 174/77 R |
| 5,113,038 | 5/1992 | Dehling | 174/77 R X |
| 5,245,133 | 9/1993 | De Carlo et al. | 174/77 R X |

FOREIGN PATENT DOCUMENTS

| | | | |
|---|---|---|---|
| 1471591 | 1/1967 | France . | |
| 1071995 | 6/1967 | United Kingdom | 174/77 R |

*Primary Examiner*—Carl J. Arbes

*Attorney, Agent, or Firm*—Ware, Fressola, Van Der Sluys & Adolphson LLP

[57] ABSTRACT

A method for electrically connecting two electrical lines. Each electrical line contains at least two electrical conductors that are insulated from each other, and one common sheath surrounding the electrical conductors. One of the two lines (2) is equipped with insulated conductors and is flexible, while the other line (1) has a stiff, tubular metal sheath. To produce a moisture-proof connection between the conductors of the electrical lines, first the sheath is removed from a section of the conductors of the flexible line (1) and insulation is removed from the conductors so that the ends are bared. The conductors prepared in this manner are placed in a flexible rubber seal (10) containing passage holes to separate the conductors. After that, the conductors of the flexible line (1) are electrically connected to the conductors of the other line (2) which protrude from the metal sheath. A metal tube (13) is then positioned over the entire connection area. Finally, one end of the tube (13) is securely connected to the metal sheath and the other end is compressed around the around the seal (10).

21 Claims, 2 Drawing Sheets

METHOD FOR ELECTRICALLY AND CONDUCTIVELY CONNECTING TWO ELECTRICAL LINES

BACKGROUND OF THE INVENTION

1. Field of the Invention

The invention concerns a method for electrically and conductively connecting two electrical lines, each of which contains at least two electrical conductors which are insulated from each other, one of the electrical lines being flexible, while the other electrical line has a stiff, tubular metal sheath.

2. Description of the Prior Art

Lines with a stiff, tubular metal sheath can be used in high temperature areas, for example areas where the temperature is 700° C. Such lines must remain stable at such high temperatures so that a signal can be transmitted without disturbance, for example. A special area of application for such high temperature lines is connection with a "Lambda sensor" which is used for monitoring motor vehicle catalyzers, e.g., catalytic converters. In this instance, the Lambda sensor is connected to electrical line conductors which are imbedded in a steel tube containing high-temperature-resistant insulation material. The steel tube serves as a metal sheath. Conductors of a flexible, temperature-resistant line are electrically and conductively connected to the conductors of the stiff steel tube enclosed line. The flexible line must not only be temperature-resistant but also moisture-proof, since it must remain operational under all possible weather conditions to which the respective motor vehicle is exposed. This also applies to the connection area between the two lines.

SUMMARY OF THE INVENTION

An Object of the invention is this provision of a moisture-proof connection between a flexible line and a stiff, metal encased line which can be established in a simple manner.

It has been found that the foregoing object can be readily attained by stripping off the insulation of conductors of a flexible line at an end of the flexible line. A flexible rubber seal containing passage holes for the separate location of the conductors is slipped over the stripped conductor ends. The rubber seal extends onto the conductor insulation. Next, the stripped ends of the flexible line conductors are electrically and conductively corrected to the conductors of another line which protrude from a metal sheath of the other line. A metal tube is then pushed over the entire connection area, and one end of the metal tube is compressed around the metal sheath, and the other end of the metal tube is compressed around the seal.

This method allows the conductors of both lines to be electrically connected in the usual manner. For example, the conductors may be welded directly to each other or to intermediate contact elements. Inside the seal, the conductors of the flexible line are kept separated and at a distance from each other by the flexible rubber seal. The subsequent compression of the metal tube not only seals the connection area against the outside, but also the end of the flexible line. The flexible rubber seal is compressed so that it lies tightly against the conductor insulation. Therefore, moisture is prevented from entering into the connection area.

The foregoing and other objects, features, and advantages of the present invention will become more apparent with respect to the following detailed description of exemplary embodiments thereof, as illustrated in the accompanying drawings.

DETAILED DESCRIPTION OF THE INVENTION

Figure 1:
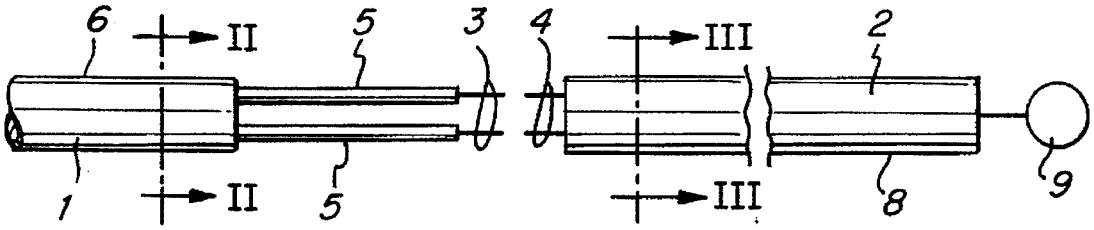
FIG. 1 is a side view of the ends of two electrical lines to be connected to each other.
Figure 2:
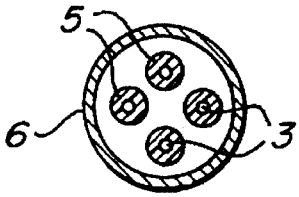
FIG. 2 is an enlarged cross-sectional view of a flexible line taken along line II—II of FIG. 1.
Figure 3:
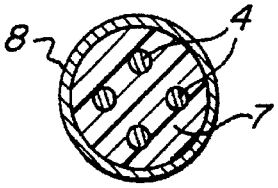
FIG. 3 is an enlarged cross-sectional view of a stiff, metal tube enclosed line, taken along line III—III of FIG. 1.

Referring to FIGS. 1, 2 and 3, two electrical lines, including a first line 1 and a second line 2, which are to be connected to each other, each contain electrical conductors 3, 4, respectively. The first and second lines 1, 2 each contain at least two conductors, 3, 4, respectively, as illustrated in FIG. 1. However, the first and second lines 1, 2 may each be provided with three or more conductors. For example, the first and second lines 1, 2 may contain four electrical conductors 3, 4, respectively, as illustrated in FIGS. 2 and 3.

The first line 1 is a flexible, temperature-resistant line. Each of its conductors 3 is surrounded by temperature-resistant insulation 5, for example polytetra-fluorethylene (PTFE). All of the insulated conductors 3 of the first line 1 are surrounded by a common sheath 6, which is also made of a temperature-resistant material, such as PTFE for example. The insulated conductors 3 may be twisted around each other and have an extruded sheath 6. However, the conductors 3 could also be relatively and individually loose in a tubular sheath 6, as illustrated in FIG. 2.

For purposes of connecting the first line 1 with the second line 2, the sheath 6 is removed up to a suitable distance from the end of the first line 1. Furthermore, a section of insulation 5 is stripped from The ends of the conductors 3.

Figure 5:
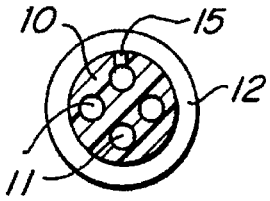
FIG. 5 is an enlarged cross-sectional view of the flexible rubber seal taken along line V—V of FIG. 4.

The four conductors 4 of the second line 2 may be made of a chrome-nickel alloy, for example. They are imbedded at a distance from each other in insulation material 7, which may be magnesium oxide, for example. The insulation material 7 is surrounded by a tubular metal sheath 8, which may be made of special steel, for example. The conductors 4 protrude from the metal sheath 8 at one end of the second line 2. The other end of the second line 2 may be connected to a measuring device 9, for example a Lambda sensor. Referring to FIGS. 1, 2, and 5 to provide a moisture-proof connection between the first and second lines 1, 2, a flexible rubber seal 10 is pushed over the conductors 3 and insulation 5 of the first line 1. The seal 10 is prefabricated and may be made of silicon rubber, for example. The seal 10 contains four separate passage holes 11 to keep the four conductors 3 separated from each other. In addition, a surrounding collar 12 having an enlarged diameter can be attached to the seal 10 at a distance from the ends of the seal. The seal 10 may be provided with an appropriate number of passage holes for any other different number of conductors in the first and second lines 1, 2.

Figure 6:
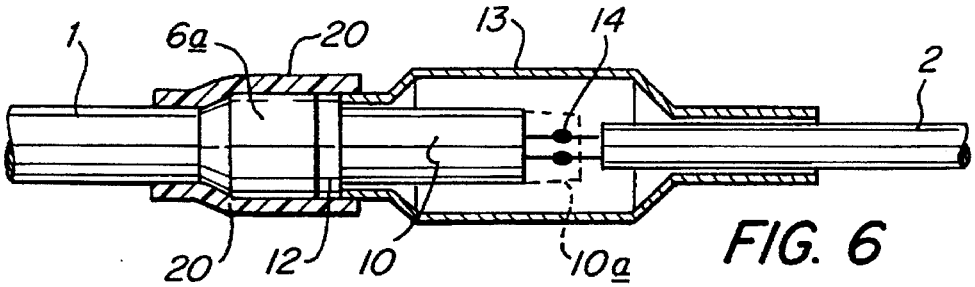
FIG. 6 is a cross-sectional view of a connection area between the electrical lines of FIG. 1.
Figure 7:
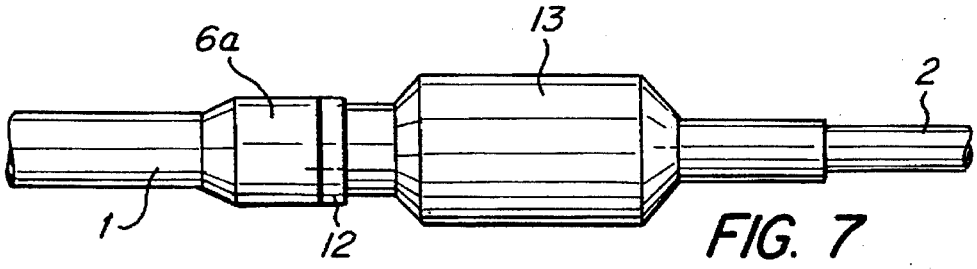
FIG. 7 is a side view of the connection between the electrical lines of FIG. 1.

Referring to FIGS. 6 and 7, the seal 10 is installed on the first line 1, and the conducts 3 of the first line 1 protrude from an end of the seal 10. The conductors 3 of the first line 1 are then electrically and conductively connected to the conducts 4 of the second line 2. Preferably, the conductors 3, 4 are welded to each other in a connection area, for example by means of a laser beam or by induction welding. After the conductors 3, 4 are welded to one another, a tube 13, made of special steel for example, is pushed over the connection area 14. Finally, both ends of the tube 13 can be compressed. Once the ends of the tube 13 are compressed, the tube 13 is sealed against moisture and is firmly attached to the metal sheath 8 on one side, and to the seal 10 on the other. The seal 10 is compressed by the compression of the metal tube 13, so that the seal 10 surrounds the conductors 3 in their insulation 5 area and makes them moisture-proof as well. The conductors 3 are unchanged and remain separated. In this way the core of the first line 1 is also closed and sealed against the entry of moisture.

If desired, the connection 14 between the conductors 3, 4 may be made with contact elements 14*a* which are first attached to the conductors 3 of the first line 1, by impact for example, for the electrically conductive connection to the conductors 4 of the second line 2, prior to the welding of the conductors 3, 4. The conductors 4 of the second line 2 are then welded together with the contact elements 14*a* in the connection area 14. The contact elements 14*a* can be tubular or U-shaped, for example.

Before the tube 13 is attached, the seal 10 can be positioned along the conductors 3 in such a way, that it extends at least partially over the connection areas 14 between conductors 3, 4 of the first and second lines, respectively, or between the contact elements 14*a* and the conductors 4 of the second line 2, as shown in phantom 10*a* in FIG. 6. To that effect, the seal 10 can have a cutout 15 (FIG. 5) extending in the axial direction, into which one of the connection areas 14 protrudes. This positions the seal 10 more accurately and prevents the seal 10 from twisting. Before the tube 13 is compressed, a section of the tubular sheath 6*a* of the first line 1 may be pushed over a section of the seal 10 which is located on the side of collar 12 opposite to the connection area 14. After the tube 13 is compressed, a shrinking tube 20 (FIG. 6) can also be shrunk over the first line 1, extending at least over the collar 12 of seal 10. Alternatively, the shrinking tube 20 may extend onto and lie against the tube 13, as shown in FIG. 6.

Figure 4:
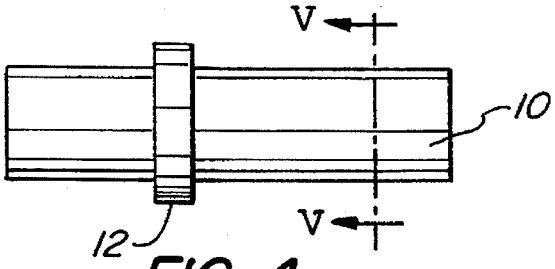
FIG. 4 is a side view of a flexible rubber seal to be used in a connection area between the two electrical lines of FIG. 1.
Figure 8:
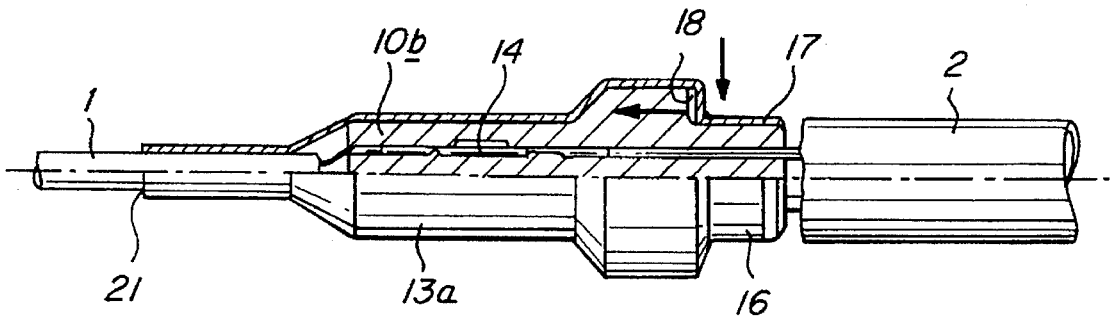
FIG. 8 is a partial cross-sectional view of a second embodiment of the invention.

Referring now to FIG. 8, to produce a connection area 14 between the first and second lines 1, 2, a seal 10*b*, which is configured differently from the seal 10 of FIG. 4, may be used. The tube 13*a* may also have a different form from the tube illustrated in FIGS. 6 and 7. The connection between the conductors of both the first and second lines 1, 2, as well as the function of the seal 10*b* and the tube 13*a*, remain unchanged with respect to the above described method.

The prefabricated seal 10*b* according to FIG. 8 is surrounded by a bond tube 16 at the end of the tube 10*b* facing the first line 1. The bond tube 16 is permanently attached to the seal 10*b* during its manufacture. For example, a circumferential bond 17 at the end of seal 10*b* serves to permanently attache the bond tube 16 to the seal 10*b*. Like the tube 13*a*, the bond tube 16 may be made of chrome-nickel. The bond tube 16 is essentially cylindrical and has a beaded edge 18 at an end that faces away from the first line 1. The sheath 6 of the first line 1 is shown partially broken away in FIG. 8 to thereby show the details of the bond tube 16; however, as with the configuration examples of FIGS. 6 and 7, the jacket may be received over an and of the seal 10*b*, and *i* this case also over the bond tube 16.

The end of tube 13*a* which is compressed around the seal 10*b* during the finishing process of the connection area 14, is bent radially inward until it contacts the bond tube 16 during the compressing. Because of the bond 17 and beaded edge 18 of the bond tube 16, this compression of the tube 13*a* onto the bond tube 16 exerts radial as well as axial forces on the seal 10*b*, as depicted by two arrows in FIG. 8. This compresses the seal 10*b* in the desired manner. Because of its configuration, the tube 13*a* lies close to the metal sheath 8 of the second line 2. The tube can additionally be cemented 21 to the metal sheath 8 of the second line 2.

Figure 9:
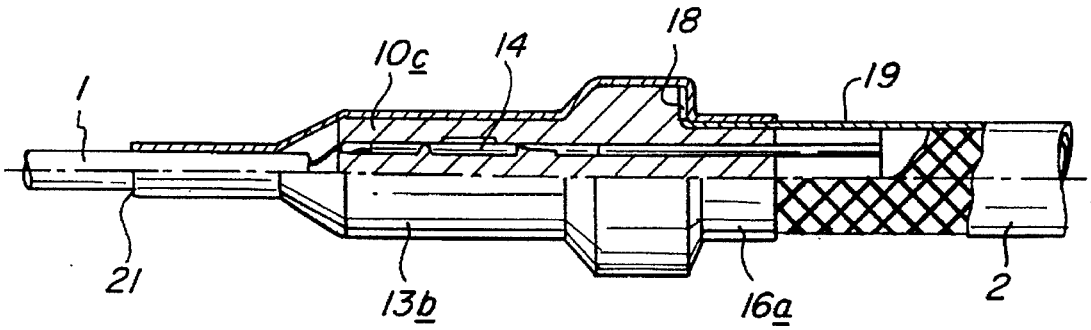
FIG. 9 is a partial cross-sectional view of a third embodiment of the invention.

In the configuration example of the connection area in FIG. 9, the first line 1 is surrounded by a metal shield 19. The shield 19 is preferably a chrome-nickel mesh which can also take over the function of armor. In this case, the bond tube 16 is only pushed over the seal 10*c* after it has been placed in its installed position. The shield 19 is placed around the seal 10*c* before the bond tube 16*a* is pushed over it. The bond tube 16 then secures the shield 19 to the seal 10*c*. The metal shield for the entire connection area has no gaps if the tube 13*b* is pressed around the bond tube 16*a*, as described with respect to FIG. 8.

Although the invention has been described and illustrated with respect to exemplary embodiments thereof, the foregoing and various other changes, omissions and additions may be made therein and thereto without departing from the spirit and scope of the present invention.

What is claimed is:

1. A method for electrically and conductively connecting a first electrical line with a second electrical line, each electrical line includes a sheath which contains at least two electrical conductors that are insulated from each other, the first electrical line is flexible and includes individually insulated conductors, and the second electrical line includes a stiff, tubular metal sheath, the method including the steps of:

stripping a section of sheath off of an end of the first electrical line;

removing insulation off of the conductors of the first electrical line adjacent to said end of the first electrical line;

providing a flexible seal containing passage holes to separate the conductors of the first electrical line;

inserting the conductors at said end of the first electrical line into said passage holes of said flexible seal and pushing said flexible seal over the conductors of the first electrical line, said flexible seal extending onto the insulation of the conductors of the first electrical line;

electrically and conductively connecting the conductors of the first electrical line to the conductors of the second electrical line, the conductors of the second electrical line protruding from the tubular metal sheath of the second electrical line;

pushing a metal tube over a connection area between the first and second electrical lines, said connection area including said flexible seal and sections of the first and second electrical lines adjacent to said flexible seal;

attaching one end of said metal tube to the metal sheath of the second electrical line; and compressing another end of said metal tube around said flexible seal adjacent to the first electrical line.

2. A method as claimed in claim 1, wherein prior to said step of pushing a metal tube over a connection area between the first and second electrical lines, a step is performed of pushing a section of the sheath of the first electrical line over an end of said flexible seal.

3. A method as claimed in claim 1, wherein said step of electrically and conductively connecting the conductors includes welding the conductors of the first and second electrical lines to each other.

4. A method as claimed in claim 3, wherein said step of welding includes welding with a laser beam.

5. A method as claimed in claim 3, wherein said step of welding includes welding by induction welding.

6. A method as claimed in claim 1, wherein said step of electrically and conductively connecting the conductors includes:

attaching contact elements to the conductors as said end of the first electrical line; and welding the conductors of the second electrical line to said contact elements.

7. A method as claimed in claim 6, wherein said step of welding includes welding with a laser beam.

8. A method as claimed in claim 6, wherein said step of welding includes welding by induction welding.

9. A method as claimed in claim 6, wherein said contact elements are tubular contact elements.

10. A method as claimed in claim 1, wherein said step of attaching one end of said metal tube to the metal sheath includes cementing said metal tube to the metal sheath of the second electrical line.

11. A method as claimed in claim 1, wherein said step of attaching one end of said metal tube to the metal sheath includes pressing said metal tube around the metal sheath of the second electrical line.

12. A method as claimed in claim 1, wherein prior to said step of inserting the conductor of the first electrical line into said passage holes, a step is performed of installing a bond tube surrounding an end of said flexible seal adjacent to the first electrical line, and wherein the step of compressing another end of said metal tube around said flexible seal includes compressing said metal tube onto said bond tube.

13. A method as claimed in claim 12, further including the steps of:

providing said first electrical line with a surrounding metal shield; and attaching said surrounding metal shield to said flexible seal with said bond tube.

14. A method as claimed in claim 1, wherein after said step of electrically and conductively connecting the conductors, said flexible rubber seal is at least partially pushed over said connection areas.

15. A method as claimed in claim 2, wherein said step of electrically and conductively connecting the conductors includes welding the conductors of the first and second electrical lines to each other.

16. A method as claimed in claim 2, wherein said step of electrically and conductively connecting the conductors includes:

attaching contact elements to the conductors as said end of the first electrical line; and welding the conductors of the second electrical line to said contact elements.

17. A method as claimed in claim 16, wherein said contact elements are tubular contact elements.

18. A method as claimed in claim 2, wherein said step of attaching one end of said metal tube to the metal sheath includes cementing said metal tube to the metal sheath of the second electrical line.

19. A method as claimed in claim 2, wherein said step of attaching one end of said metal tube to the metal sheath includes pressing said metal tube around the metal sheath of the second electrical line.

20. A method as claimed in claim 2, wherein prior to said step of inserting the conductor of the first electrical line into said passage holes, a step is performed of installing a bond tube surrounding an end of said flexible seal adjacent to the first electrical line, and wherein the step of compressing another end of said metal tube around said flexible seal includes compressing said metal tube onto said bond tube.

21. A method as claimed in claim 20, further including the steps of:

providing said first electrical line with a surrounding metal shield; and attaching said surrounding metal shield to said flexible seal with said bond tube.

* * * * *